US010368616B2

(12) United States Patent
Burke et al.

(10) Patent No.: US 10,368,616 B2
(45) Date of Patent: Aug. 6, 2019

(54) ZIPPER ASSEMBLY

(71) Applicant: NIKE, Inc., Beaverton, OR (US)

(72) Inventors: Christine Burke, Beaverton, OR (US); Stephanie J. Scott, Portland, OR (US); Rebecca M. Sheehan, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 314 days.

(21) Appl. No.: 15/366,815

(22) Filed: Dec. 1, 2016

(65) Prior Publication Data

US 2017/0156453 A1 Jun. 8, 2017

Related U.S. Application Data

(60) Provisional application No. 62/262,127, filed on Dec. 2, 2015.

(51) Int. Cl.
*A44B 19/30* (2006.01)
*A44B 19/26* (2006.01)
(Continued)

(52) U.S. Cl.
CPC ..... *A44B 19/30* (2013.01); *A41F 1/00* (2013.01); *A43C 11/12* (2013.01); *A43C 11/20* (2013.01);
(Continued)

(58) Field of Classification Search
CPC ..... A41F 1/008; A41F 1/00; A41D 2300/322; A41D 1/02; A41D 27/00; A41D 1/04; A41D 27/201; A41D 27/20; A41B 2300/322; A41B 1/10; A44B 19/30; A44B 19/301; A44B 19/262; A44B 19/306; A44B 19/02; A44B 19/36; A45C 13/103; A45C 13/1023; A45C 13/20; A43C 11/20;
(Continued)

(56) References Cited

U.S. PATENT DOCUMENTS 2,223,347 A * 12/1940 Axthelm ..... A44B 19/301 24/387
2,688,138 A * 9/1954 Glass ..... A44B 19/301 2/218
(Continued)

FOREIGN PATENT DOCUMENTS

EP 1929895 A1 6/2008
FR 1428507 A * 2/1966

OTHER PUBLICATIONS

International Search Report and Written Opinion dated Feb. 13, 2017 in International Application No. PCT/US2016/064754, 12 pages.
(Continued)

*Primary Examiner* — Amy Vanatta
(74) *Attorney, Agent, or Firm* — Shook, Hardy and Bacon LLP

(57) ABSTRACT

A zipper assembly includes various elements, such as a zipper-slider body and a zipper puller. The zipper puller can be gripped when manually traversing the zipper-slider body along zipper-teeth assemblies, such as when releasably fastening portions or edges of an article together. In addition, the zipper puller includes one or more additional hooking loops that releasably attach onto other surfaces or items.

16 Claims, 9 Drawing Sheets

(51) Int. Cl.

| | |
|---|---|
| ***A45C 13/10*** | (2006.01) |
| ***A41F 1/00*** | (2006.01) |
| ***A43C 11/12*** | (2006.01) |
| ***A44B 19/02*** | (2006.01) |
| ***A43C 11/20*** | (2006.01) |
| *A41D 1/02* | (2006.01) |
| *A41D 1/04* | (2006.01) |
| *A41D 27/20* | (2006.01) |

(52) U.S. Cl.
CPC ..... *A44B 19/02* (2013.01); *A44B 19/262* (2013.01); *A45C 13/103* (2013.01); *A41D 1/02* (2013.01); *A41D 1/04* (2013.01); *A41D 27/201* (2013.01); *A41D 2300/322* (2013.01)

(58) Field of Classification Search
CPC . A43C 11/12; Y10T 24/2511; Y10T 24/2513; Y10T 24/2566; Y10T 24/2561; Y10T 70/2598; Y10T 70/5053; Y10T 70/2586
USPC ..... 2/96; 190/120; 24/387, 388, 408, 415
See application file for complete search history.

(56) References Cited

U.S. PATENT DOCUMENTS

| | | | | | |
|---|---|---|---|---|---|
| 3,112,545 | A * | 12/1963 | Williams | A43C 11/12 | 24/390 |
| 3,271,832 | A * | 9/1966 | Yankers | A44B 19/301 | 2/234 |
| 4,928,363 | A * | 5/1990 | Easton | A44B 19/301 | 24/370 |
| 5,040,274 | A * | 8/1991 | Keech | A43C 11/008 | 24/381 |
| 7,979,964 | B2 * | 7/2011 | Jans | A44B 19/301 | 24/386 |
| 8,533,918 | B1 * | 9/2013 | Ketter | A44B 19/285 | 2/218 |
| 2003/0101548 | A1 * | 6/2003 | Tang | A44B 19/262 | 24/429 |
| 2005/0035605 | A1 * | 2/2005 | Vanderwater-Piercy | A44B 19/301 | 292/308 |
| 2005/0257351 | A1 * | 11/2005 | Pitts | A44B 19/262 | 24/436 |
| 2009/0276984 | A1 * | 11/2009 | Rabe | A44B 19/301 | 24/388 |
| 2012/0174347 | A1 * | 7/2012 | Higgins | A44B 19/301 | 24/390 |
| 2012/0222272 | A1 * | 9/2012 | Moreland | A44B 19/262 | 24/385 |
| 2013/0299540 | A1 * | 11/2013 | Avganim | A45C 13/18 | 224/600 |
| 2015/0230572 | A1 * | 8/2015 | Godshaw | A45C 3/001 | 150/101 |
| 2017/0020239 | A1 * | 1/2017 | Cowdery | A44B 19/26 | |

OTHER PUBLICATIONS

International Preliminary Report on Patentability dated Jun. 14, 2018 in International Application No. PCT/US2016/064754, 8 pages.

* cited by examiner

ZIPPER ASSEMBLY

CROSS-REFERENCE TO RELATED APPLICATIONS

This application claims priority to U.S. Provisional Application No. 62/262,127 (filed Dec. 2, 2015), which is incorporated herein by reference in its entirety.

BRIEF SUMMARY

A zipper assembly includes various elements, such as a zipper-slider body and a zipper puller. The zipper puller can be gripped when manually traversing the zipper-slider body along zipper-teeth assemblies, such as when releasably fastening portions or edges of an article together. In addition, the zipper puller includes one or more additional hooking loops that releasably attach onto other surfaces or items.

Aspects of the technology are defined by the claims below, not this Brief Summary. A high-level overview of various aspects of the technology is provided in this section to introduce a selection of concepts that are further described below in the detailed description. This Brief Summary is not intended to identify key features or essential features of the claimed subject matter, nor is it intended to be used as an aid in isolation to determine the scope of the claimed subject matter.

BRIEF DESCRIPTION OF THE DRAWINGS

The present invention is described in detail herein with reference to the attached drawing figures, which are incorporated herein by reference, wherein.

DETAILED DESCRIPTION

Subject matter is described throughout this Specification in detail and with specificity in order to meet statutory requirements. But the aspects described throughout this Specification are intended to be illustrative rather than restrictive, and the description itself is not intended necessarily to limit the scope of the claims. Rather, the claimed subject matter might be practiced in other ways to include different elements or combinations of elements that are similar to the ones described in this Specification and that are in conjunction with other present, or future, technologies. Upon reading the present disclosure, alternative aspects may become apparent to ordinary skilled artisans that practice in areas relevant to the described aspects, without departing from the scope of this disclosure. It will be understood that certain features and subcombinations are of utility and may be employed without reference to other features and subcombinations. This is contemplated by, and is within the scope of, the claims.

The subject matter described in this Specification generally relates to a zipper assembly. Among other things, the zipper assembly is usable to releasably fasten portions or edges of an article together, such as a garment, a bag, a footwear article, and the like. In addition, the zipper assembly includes a zipper puller that provides additional functionality, and in this sense, the zipper puller is a multi-function zipper puller. For example, the zipper puller includes one or more additional hooking loops that releasably attach onto other surfaces or items. This hooking functionality of the zipper puller may be utilized in various manners. For instance, the additional hooking functionality of the zipper puller may be used to secure a zipper-slider body in a partial-zip arrangement relative to the article. Securing the zipper-slider body in a partial-zip arrangement may be helpful in various contexts, such as when partially zipping or unzipping a garment or shoe or when securing a bag pocket in a partially zipped position. These and other operations of a zipper puller will be described in additional detail in other portions of this Specification.

Figure 3:
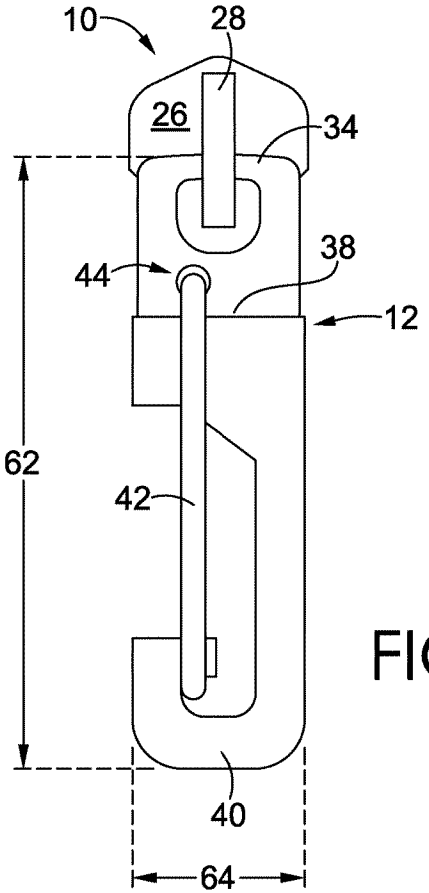
FIG. 3 depicts a plan view of the zipper-slider body and the zipper puller in accordance with an aspect hereof.
Figure 1:
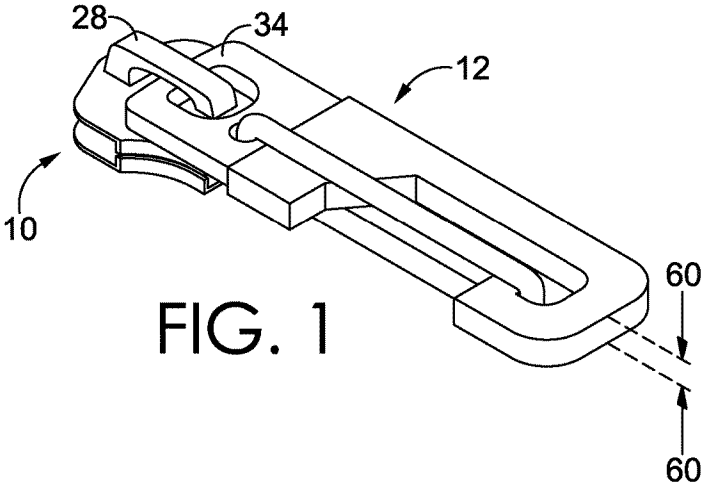
FIG. 1 depicts a perspective view of a zipper-slider body in combination with a zipper puller in accordance with an aspect hereof.
Figure 2:
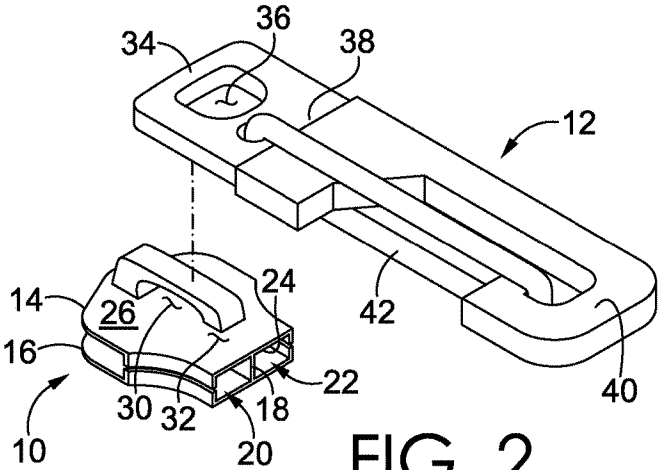
FIG. 2 depicts a perspective view of the zipper-slider body and the zipper puller in a decoupled state in accordance with an aspect hereof.

Referring now to FIGS. 1, 2, and 3, exemplary elements of a zipper assembly are depicted, including a zipper-slider body 10 and a zipper puller 12. Generally, the zipper puller 12 attaches to the zipper-slider body 10, and the zipper puller 12 may be grasped and pulled to traverse the zipper-slider body 10 along a set of zipper teeth in order to either couple (i.e., zip) or decouple (i.e., unzip) the teeth. The zipper-slider body 10 includes various structures that facilitate zipping or unzipping a set of zipper teeth. For example, the zipper-slider body 10 includes a first plate 14, a second plate 16, and a web 18 that extends between and couples the first plate 14 to the second plate 16. The first plate 14, the second plate 16, and the web 18 form a first zipper-teeth guide slot 20 on a first side of the web 18 and a second zipper-teeth guide slot 22 on a second side of the web 18. As such, a first set of zipper teeth and a second set of zipper teeth are passable through a respective guide slot when the zipper-slider body 10 is pulled from one portion of the zipper to another portion of the zipper. The first and second set of zipper teeth are either coupled (i.e., zipped) or uncoupled (i.e., unzipped) by the zipper-slider body 10 depending on which direction the zipper-slider body 10 is traversed. The zipper-slider body 10 depicted in FIG. 1 is illustrative and various other zipper-slider bodies may also be included in other aspects of the present disclosure. For example, the first plate 14, the second plate 16, and the web 18 may include one or more discrete structures that are coupled together to form the multiple zipper-teeth guide slots.

As previously indicated, the zipper puller 12 is attached directly to the zipper-slider body 10 in an aspect of the present disclosure. For example, the first plate 14 includes a web-facing surface 24 that faces towards the web 18 and towards the slots 20 and 22. In addition, the first plate 14 includes a puller-facing surface 26 that faces away from the web-facing surface 24. The zipper-slider body 10 includes a puller-retention link 28 that protrudes from the web-facing surface 24 and that forms a loop with a linking aperture 30 (e.g., FIG. 2).

The puller-retention link 28 may include various structures. For instance, the puller-retention link 28 may be a lug that is affixed to, or integrally formed with, the puller-facing surface 26. In another instance, the puller-retention link 28 may include one or more rigid or flexible members that pass through one or more holes in the first plate 14 to extend from the web-facing surface 24 to above the puller-facing surface 26. The puller-retention link 28 may form a closed loop with the puller-facing surface 26. Or the puller-retention link 28 may form a partially closed loop. For example, in FIG. 2 an end of the puller-retention link 28 is spaced apart from the puller-facing surface 26 by a gap 32, such that the puller-retention link 28 and the puller-facing surface 26 form a partially-closed loop.

The zipper puller 12 may attach to the zipper-slider body 10 in various manners. In the illustrative figures, the zipper puller 12 includes a puller attachment loop 34. The puller attachment loop 34 includes one or more sides that form a perimeter at least partially around a puller attachment window 36. In the illustrative zipper puller 12, the puller attachment loop 34 forms a closed loop around the puller attachment window 36. And in other aspects, the puller attachment loop 34 may form a partially closed loop. In order to attach the zipper puller 12 to the zipper-slider body 10, the puller-retention link 28 of the zipper-slider body 10 is interlinked with the puller attachment loop 34 of the zipper puller 12. For example, an open end of the puller-retention link 28 might be passed through the puller attachment window 36. In addition, the puller attachment loop 34 may include an open portion (e.g., U-shaped clip) that is interlinked with the puller-retention link 28 and then coupled to (e.g., inserted into) a portion of the zipper puller 12.

The zipper puller 12 also includes a hitch loop 40 that is usable to releasably attach the zipper puller 12 to other surfaces or objects. The hitch loop 40 and the puller attachment loop 34 are integrally formed with, or are coupled to, a cross member 38 that separates the hitch loop 40 and the puller attachment loop 34 and that serves as a base or foundation for the hitch loop 40 and the puller attachment loop 34. The cross member 38 is depicted as a plate for illustrative purposes. And in other aspects the cross member 38 may take other forms, such one or more bars or other structural bases that divides the puller attachment loop 34 and the hitch loop 40 and that provides a foundation from which the puller attachment loop 34 and the hitch loop 40 may extend. The cross member 38 also provides a dividing structure to impede interference between the puller-retention link 28 and another object (e.g., anchor 50 in FIGS. 4-9) that might be retained within the hitch loop 40.

In addition, the zipper puller 12 includes a gate 42 that is movable between an open and a closed position. For example, the zipper puller 12 includes a spring-loaded coupling 44 that attaches the gate 42 to the cross member 38. The spring-loaded coupling 44 may include various structures that bias the gate 42 in a closed position (depicted in FIGS. 1-3). For example, the spring-loaded coupling 44 may include a coil spring, flat spring, cantilevered spring, and the like. The gate 42 is illustratively depicted as a wire gate. And in other aspects, the gate 42 may include other types of spring-loaded gates, such as a straight gate, screw gate, twin gate, and the like. In a further aspect, the hitch loop 40 and the gate 42 may include at least part of a carabiner. Although a spring-loaded gate is depicted in several of the figures described in this Specification, in other aspects different styles of gates may be utilized. For example, one aspect includes a maillon-type link having a threaded nut.

Portions of the zipper puller 12 may be formed from various materials. For example, the puller attachment loop 34, the cross member 38, and the hitch loop 40 may be cast or injection molded as a single part from a polymer (e.g., polyester, thermoplastic polyurethane, etc.), metal, composite, and the like. Or, the puller attachment loop 34, the cross member 38, and the hitch loop 40 may be formed as two or more separate parts that are assembled by mechanical connections, adhesives, welding, at the like. The material(s) from which the zipper puller 12 is constructed may have various characteristics, such as threshold hardness or shear properties able to withstand pulling forces. For example, pulling forces may be applied to the zipper puller 12 as a result of being used to adjust a zipper position, being used to attach the zipper puller to another part of an article, or using the zipper puller to attach the article to another object. In addition, one or more surfaces of the zipper puller 12 may be finished to include a grip-enhancing surface that may increase friction between the zipper puller and, for example, a user's gripping fingers. For example, the zipper puller 12 may include a knurled finish or other surface finish that is molded in, stamped in, or cut into the zipper puller. In addition, the zipper puller 12 may include a coating, such as a rubber coating, silicone coating, or the like.

The zipper puller 12 may have various dimensions that contribute to the multi-functional nature of the zipper puller 12. FIG. 1 depicts that the zipper puller 12 includes a thickness 60, and FIG. 3 depicts that the zipper puller 12 includes a length 62 and a width 64. The thickness 60, the length 62, and the width 64 may include various sizes that are suitable both for gripping in a zipper-pulling capacity and for hitching when the zipper puller 12 is used to hook onto another surface. For example, the thickness 60 may be in a range of about 5 mm to about 10 mm. However, the thickness 60 may also be below 5 mm or above 10 mm in other aspects. In addition, the length 62 may be in a range of about 20 mm to about 40 mm. But the length 62 may also be below 20 mm or above 40 mm in other aspects. Furthermore, the width 64 may be in a range of about 6 mm to about 11 mm. And other aspects may include a width 64 that is less than 6 mm or greater than 11 mm.

Figure 4:
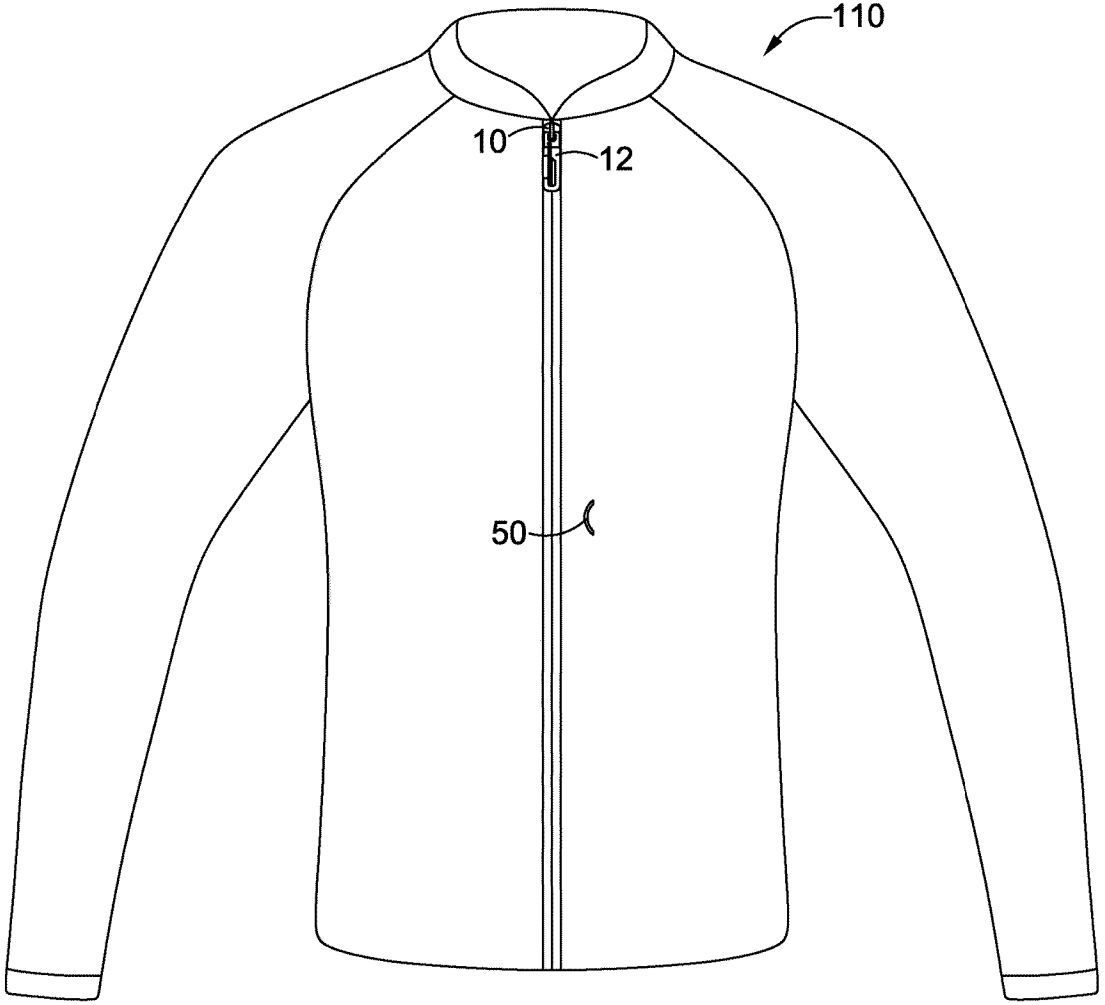
FIG. 4 depicts a garment with a zipper assembly in accordance with an aspect hereof.
Figure 5:
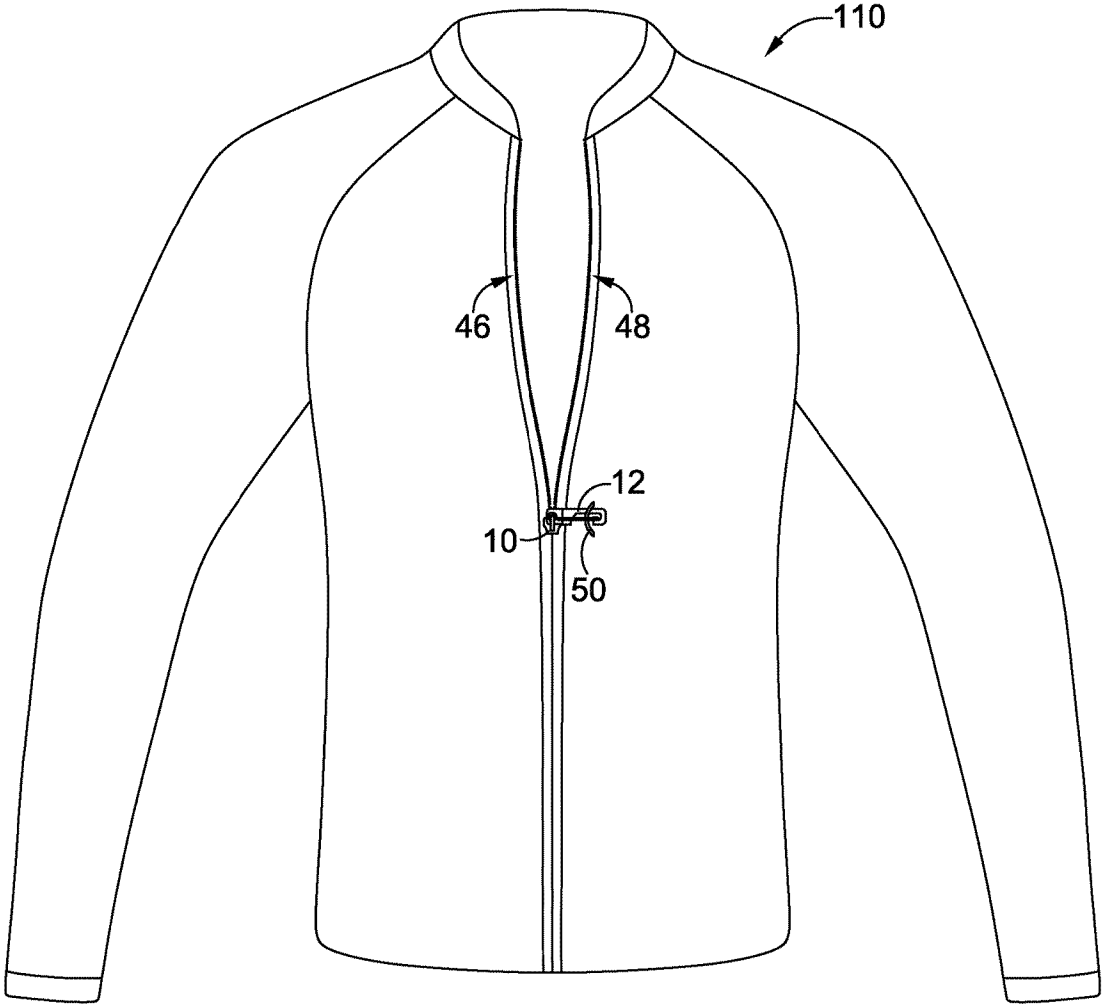
FIG. 5 depicts the garment of FIG. 4 in a partially unzipped state in accordance with an aspect hereof.

The zipper puller 12 may be configured as a multi-functional element in various contexts. Referring now to FIGS. 4 and 5, a garment 110 is depicted that includes the zipper puller 12. In addition, the garment 110 includes a first zipper-teeth assembly 46 and a second zipper-teeth assembly 48. A zipper-teeth assembly may include various structures that attach a set of zipper teeth to a portion of the garment and that allow the zipper slider to traverse from one end of the zipper-teeth assembly to another end of the zipper teeth assembly. For example, in the garment 110, the zipper-teeth assemblies 46 and 48 may each include a zipper tape attached to a portion of the garment 110, a set of zipper teeth attached to a respective zipper tape, and a stop coupled to the zipper tape near a collar portion of the garment 110. In addition, one of the zipper-teeth assemblies 46 may include a zipper box, and the other zipper-teeth assembly 48 may include a zipper pin.

In an aspect of the present disclosure, the zipper assembly depicted in FIGS. 4 and 5 includes an anchor 50 that is attached to the garment 110 and that is positioned between a first end and a second end of the zipper-teeth assemblies 46 and 48. For instance, the anchor 50 may be a cord loop, fabric loop, wire loop, or other looped structure. As depicted in FIG. 5, when the zipper-teeth assemblies 46 and 48 are partially unzipped (e.g., quarter zip, half zip, etc.) by adjusting a position of the zipper-slider body 10, the zipper puller 12 can be hitched to the anchor 50 using the hitch loop 40 in order to secure a position of the zipper-slider body 10. In this sense, the anchor 50 may be a zipper-slider anchor since it at least partially retains or fixes a position of the zipper-slider body.

Among other functions, securing a position of the zipper-slider body 10 in a partial-zip arrangement can help to secure the garment 110 to a wearer. In addition, the anchor 50 can be strategically positioned at different positions along the zipper-teeth assemblies to provide ventilation with pre-configured sizing based on a position of the anchor 50. Although FIGS. 4 and 5 depict a single anchor 50, multiple anchors can be positioned at different positions along garment to provide a variety of pre-sized vents. In addition, although the anchor 50 is depicted on an exterior of the garment 110, one or more anchors may be coupled to an interior surface of the garment 110. Moreover, although the anchor 50 is depicted partially between the ends of the zipper-teeth assemblies, in another aspect an anchor may be positioned near a collar of the garment 110 in order to help secure the zipper in a closed state and to prevent unintentional unzipping.

Figure 6:
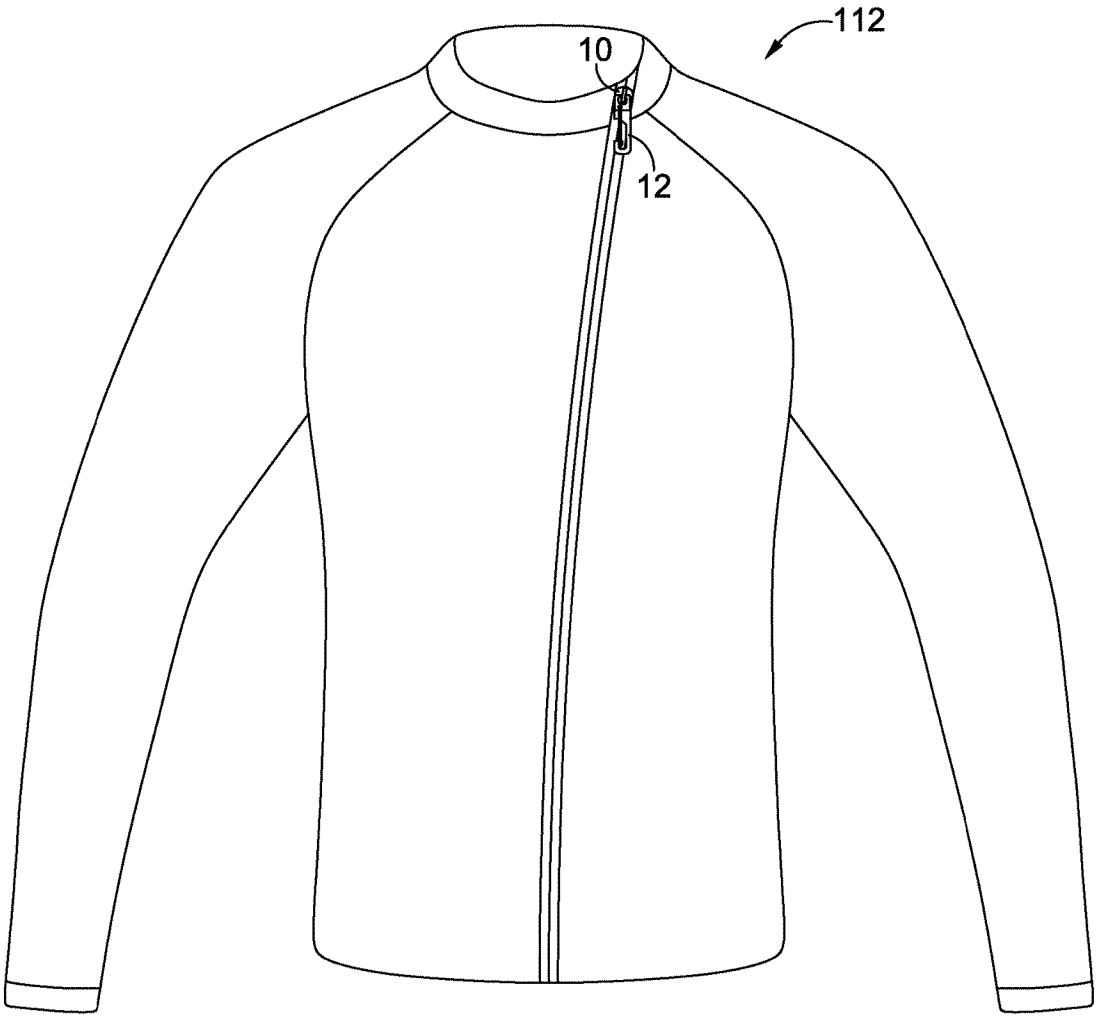
FIG. 6 depicts another garment with a zipper assembly in accordance with an aspect hereof.
Figure 7:
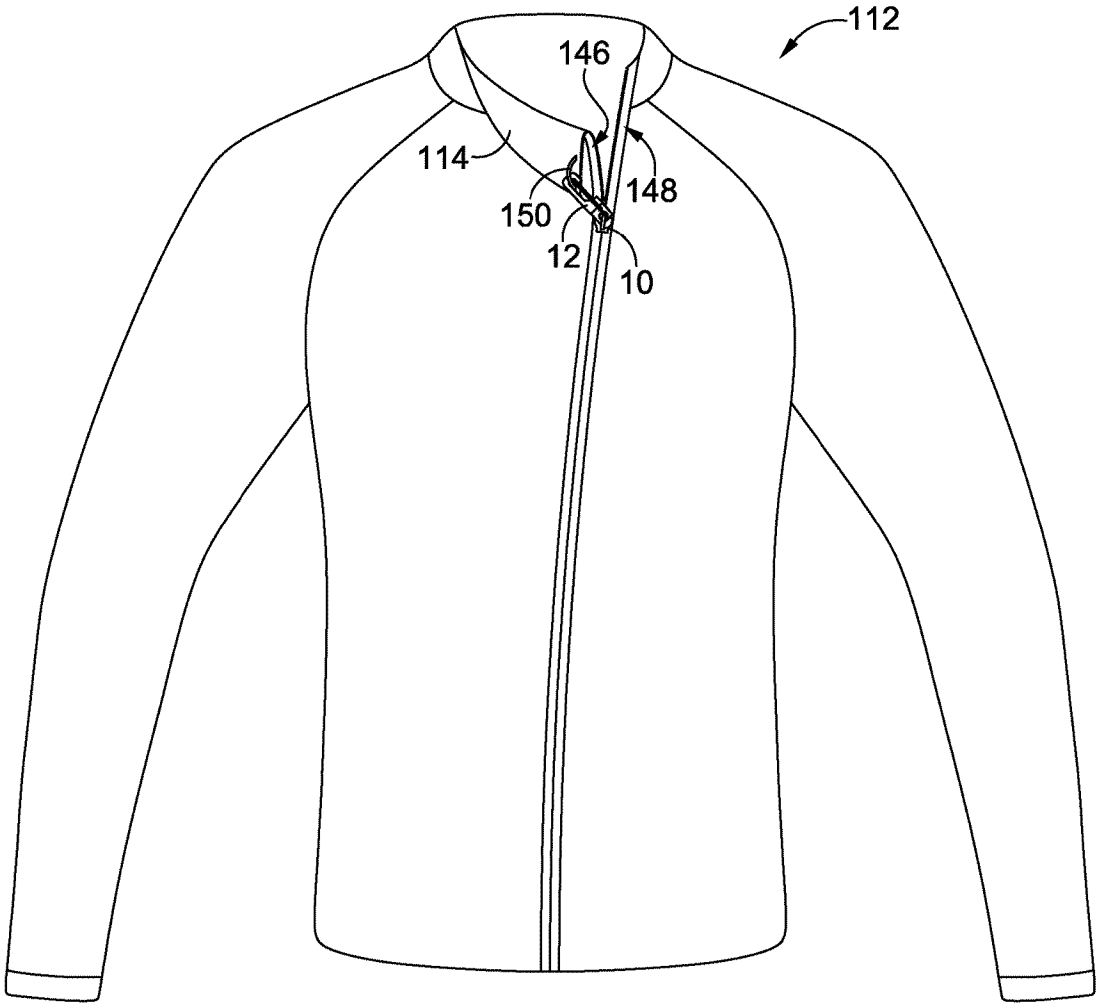
FIG. 7 depicts the garment of FIG. 6 in a partially unzipped state in accordance with an aspect hereof.

Referring to FIGS. 6 and 7 another garment 112 is depicted that includes the zipper puller 12. The garment 112 includes offset zipper-teeth assemblies 146 and 148. Due in part to the offset nature of the zipper-teeth assemblies 146 and 148, a flap 114 is loosed when the zipper-teeth assemblies 146 and 148 are at least partially unzipped. In accordance with an aspect of the present invention, the zipper assembly includes an anchor 50 that is attached to the flap 114 and that is securable to the hitch loop 40 of the zipper puller 12. For example, the hitch loop 40 might be attached to the anchor 50 when the zipper-teeth assemblies 146 and 148 are at least partially unzipped. Affixing the anchor 50 of the flap 114 to the zipper puller 12 can reduce the extent to which the flap 114 freely flutters or waves when the zipper-teeth assemblies 146 and 148 are at least partially unzipped. The anchor 50 can be strategically positioned at different positions along the flap 114 to help secure the flap 114 against the garment 112. Although FIG. 7 depicts a single anchor 50, multiple anchors can be positioned at different positions along garment 112 to provide a variety of pre-configured anchor positions. In addition, although the anchor 50 is depicted on an interior of the garment 112, one or more anchors may be coupled to an exterior surface of the flap 114.

Figure 8:
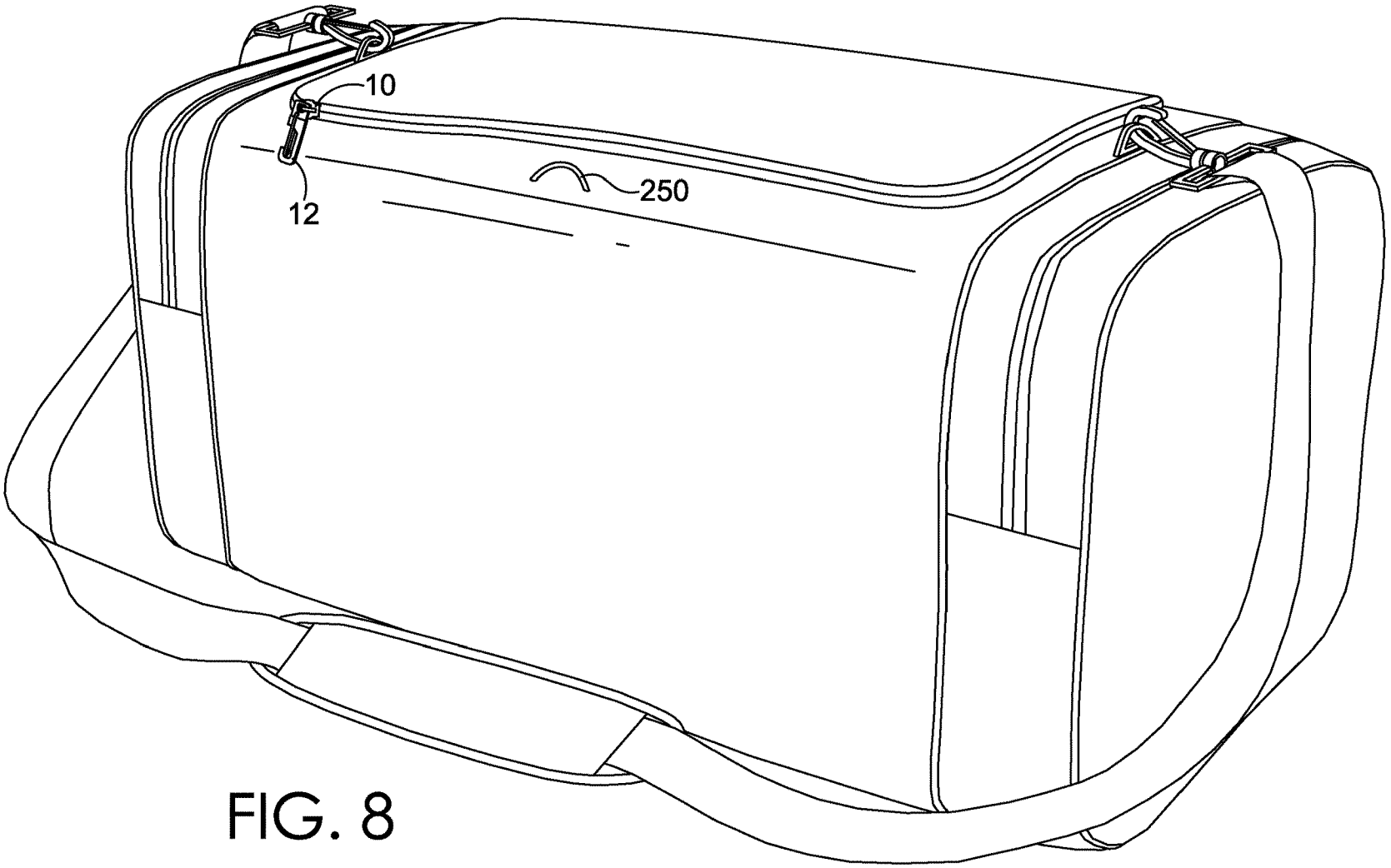
FIG. 8 depicts a bag with a zipper assembly in accordance with an aspect hereof.
Figure 9:
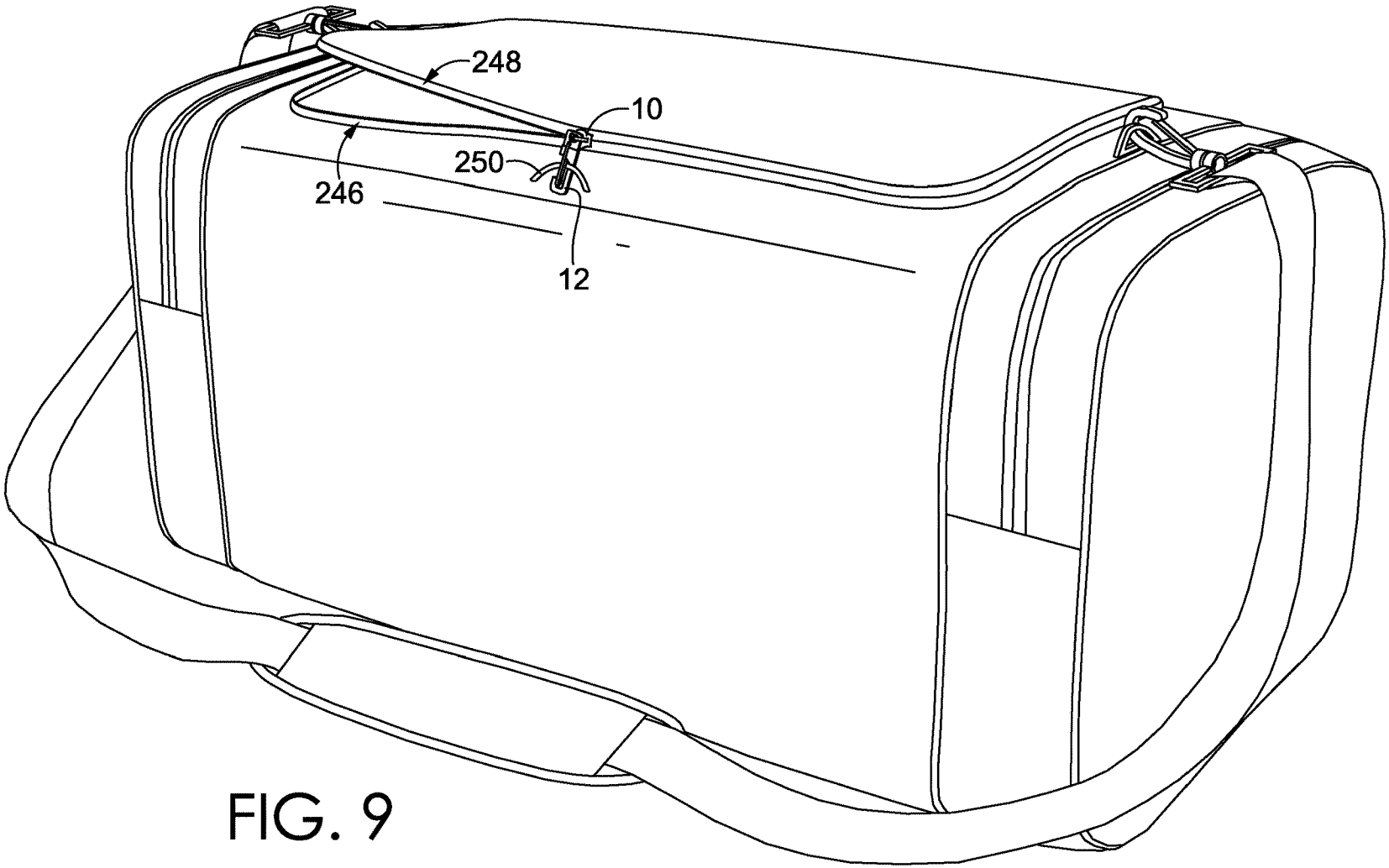
FIG. 9 depicts the bag of FIG. 8 in a partially unzipped state in accordance with an aspect hereof.

Referring now to FIGS. 8 and 9, a bag is depicted that includes the zipper puller 12. The bag includes a first zipper-teeth assembly 246 and a second zipper-teeth assembly 248. The zipper-teeth assemblies 246 and 248 may be attached to one another at both ends, such that the zipper-teeth assemblies 246 and 248 share a first zipper stop at one end and a second zipper stop at an opposing end. In an aspect of the present disclosure, the zipper assembly depicted in FIGS. 8 and 9 includes an anchor 50 that is attached to the bag and that is positioned between a first end and a second end of the zipper-teeth assemblies 246 and 248. As previously described, the anchor 50 may be a cord loop, fabric loop, wire loop, or other looped structure. As depicted in FIG. 9, when the zipper-teeth assemblies 246 and 248 are partially unzipped (e.g., quarter zip, half zip, etc.) by adjusting a position of the zipper-slider body 10, the zipper puller 12 can be hitched to the anchor 50 using the hitch loop 40 in order to secure a position of the zipper-slider body 10.

Among other functions, securing a position of the zipper-slider body 10 can help to impede the zipper assembly from being unintentionally opened more than an intended amount. In addition, the anchor 50 can be strategically positioned at different positions along the zipper-teeth assemblies to provide pre-sized zippered openings. Although FIGS. 8 and 9 depict a single anchor 50, multiple anchors can be positioned at different positions along the bag. In addition, an anchor might be placed adjacent to a closed end of the zipper-teeth assemblies 246 and 248 to impeded unintentional opening by securing the hitch loop 40 of the zipper puller 12 when the zipper is completely closed (i.e., zipped).

Figure 10:
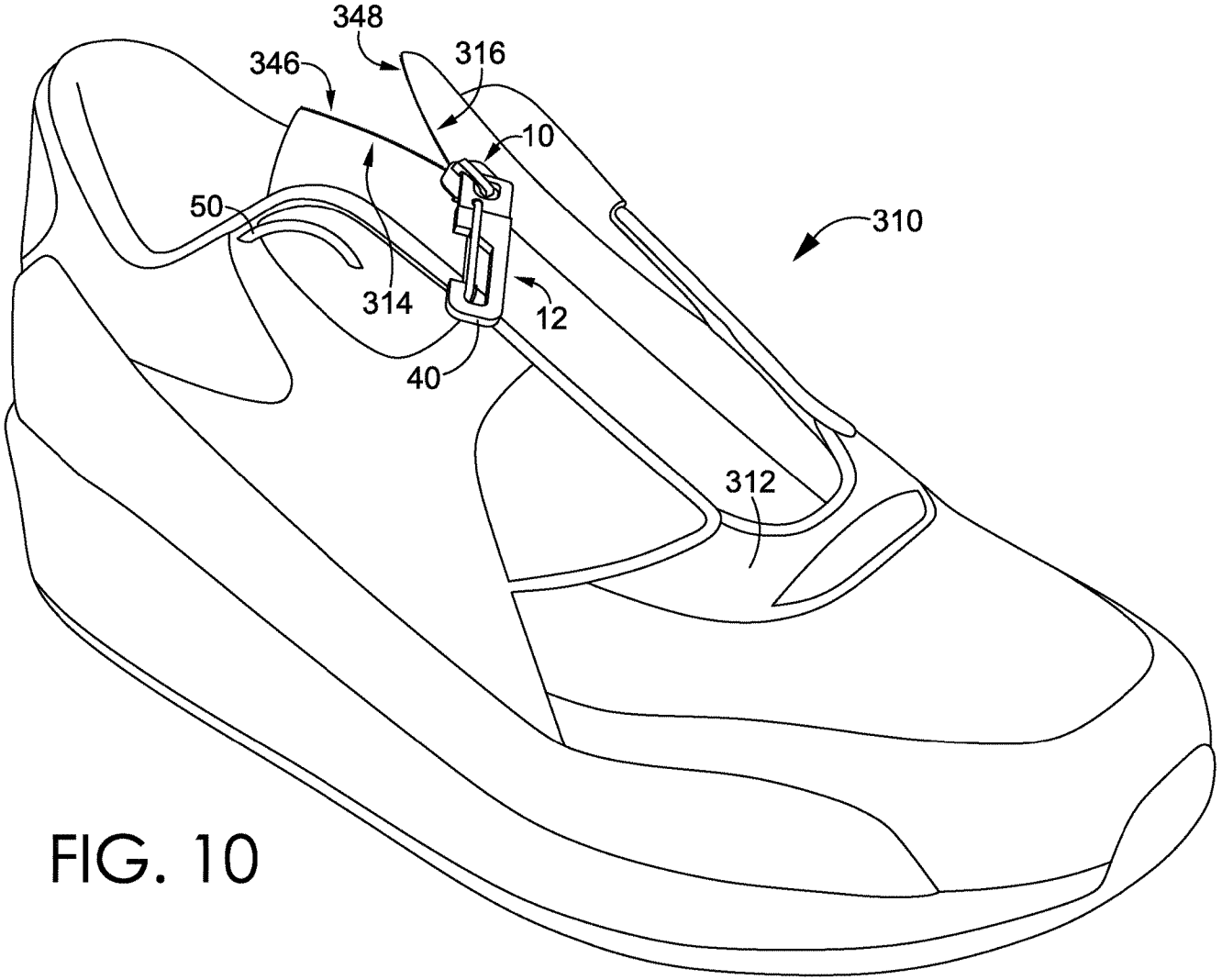
FIG. 10 depicts a footwear article with a zipper assembly in accordance with an aspect hereof.

Referring now to FIG. 10, a footwear article 310 is depicted that includes the zipper puller 12. In addition, the footwear article 310 includes an upper 312 having a first edge 314 and a second edge 316. In addition, the footwear article includes a first zipper-teeth assembly 346 coupled to the first edge 314 and a second zipper-teeth assembly 348 coupled near the second edge 316. The zipper-teeth assemblies 346 and 348 may be secured to one another at one end by a shared stop element (not depicted).

In an aspect of the present disclosure, the zipper assembly depicted FIG. 10 includes an anchor 50 that is attached to the footwear article 310 and that is near the collar of the footwear article 310. For instance, the anchor 50 may be a cord loop, fabric loop, wire loop, or other looped structure. When the zipper-teeth assemblies 346 and 348 are zipped by adjusting a position of the zipper-slider body 10, the zipper puller 12 can be hitched to the anchor 50 using the hitch loop 40 in order to secure a position of the zipper-slider body 10.

Among other functions, securing a position of the zipper-slider body 10 in a fully-zipped arrangement can help to secure the footwear article 310 to a wearer. In addition, the anchor 50 (or additional anchors) can be strategically positioned at different positions along the zipper-teeth assemblies to provide pre-configured sizing based on a position of the anchor 50. In addition, although the anchor 50 is depicted on an exterior of the footwear article 310, one or more anchors may be coupled to an interior surface of the footwear article 310. In another aspect, the zipper puller 12 may be attached to another garment, such as a pant leg, to secure the garment in a position relative to the footwear article 310.

The zipper puller 12 may be utilized in other contexts as well. For example, the zipper puller 12 may be utilized to releasably couple an article to another item or to another surface. For instance, the zipper-puller hook functionality may be used to hang a garment, a bag, or a footwear article in a storage location. In addition, the zipper puller 12 may be strategically positioned on various types of bag or garment pockets to releasably clip onto various items. For instance, an internal stow pocket might be equipped with the zipper puller 12 to clip a key ring or other item. In another aspect, a zipper puller 12 might be strategically positioned to clip onto a media cord (e.g., head-phone cord). A zipper puller 12 might also be strategically positioned to clip onto a tag, such as a ski-lift ticket. These are merely exemplary, non-limiting aspects, and the zipper puller 12 might be used to releasably clip onto various other items and surfaces.

Figure 11:
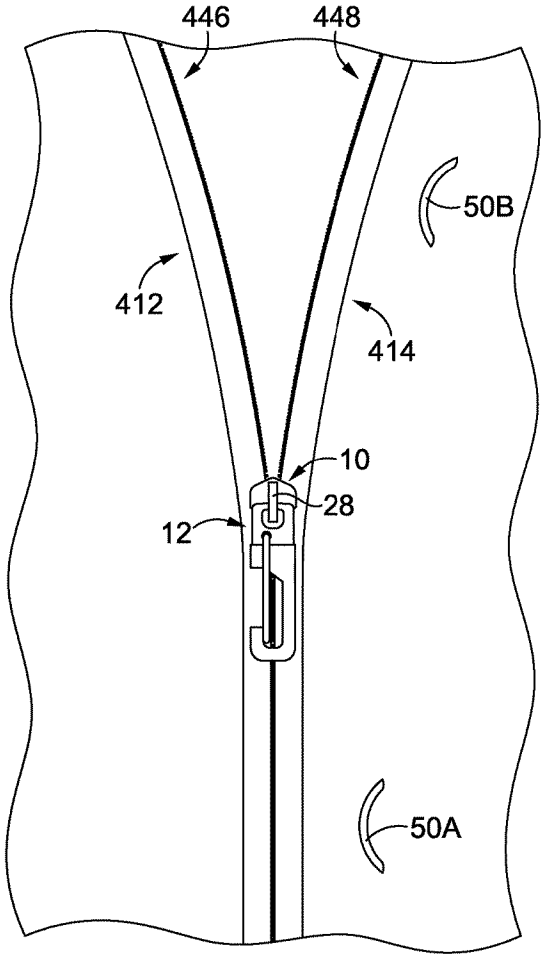
FIG. 11 depicts a portion of an article that includes a zipper assembly in accordance with an aspect hereof.

Referring now to FIG. 11, another aspect of the disclosure is illustratively depicted. FIG. 11 depicts a partial view of an article 410. The article 410 may include various items, such as a garment, a bag, a footwear article, and the like. The article includes a first textile edge 412 and a second textile edge 414. The first textile edge 412 and the second textile edge 414 may be positioned in various locations on a respective article. For instance, if the article 410 is an upper-body garment (e.g., jacket), then the textile edges may form an opening along a front portion of the upper-body garment. In addition, the textile edges may form an opening to a pocket, which may be an external pocket or an internal pocket. In another aspect in which the article 410 is a bag (e.g., duffel bag, backpack, knapsack, etc.), the textile edges may form a closable opening for a main compartment or for an accessory compartment. When the article 410 is a footwear article, the textile edges may extend through portions of an upper, such as from the vamp area of the upper to the collar portion of the upper.

In FIG. 11 a first zipper-teeth assembly 446 is attached near the first textile edge 412 and a second zipper-teeth assembly 448 is attached near the second textile edge 414. In addition, the article 410 includes a zipper-slider body 10 that is attachable to the first zipper-teeth assembly 446 and the second zipper teeth assembly 448, the zipper-slider body having a puller-retention link 28. The first textile edge 412 is releasably attachable to the second textile edge 414 by traversing the zipper-slider body 10 along the first zipper-teeth assembly 446 and the second zipper-teeth assembly 448. In addition, the zipper-slider body 10 is traversable through a series of slider positions along the first and second zipper-teeth assemblies in order to zip the assemblies by a selectable amount (e.g., fully zipped, half zipped, quarter zipped, etc.) The article 410 also includes a zipper puller 12 coupled directly to the zipper-slider body 10. As described in other parts of this disclosure, the zipper puller includes a puller attachment loop and a hitch loop that are separated by a cross member, the puller attachment loop being interlocked with the puller-retention link. In addition, the hitch loop includes a gate that is movable between an open position and a closed position.

In FIG. 11 the article 410 also includes a zipper-slider anchor 50A, and the hitch loop 40 is releasably attachable to the zipper-slider anchor 50A when the zipper-slider body 10 is located at a particular slider position near the anchor 50A. Moreover, traversal of the zipper-slider body along the first and second zipper-teeth assemblies is impeded when the hitch loop is attached to the zipper-slider anchor 50A. For instance, traversal of the zipper-slider body 10 upward or downward (relative to the perspective shown in FIG. 11) would be impeded when the hitch loop 40 is coupled to the anchor 50A.

In a further aspect, the article 410 includes a plurality of zipper-slider anchors, including the zipper-slider anchor 50A and at least one other zipper-slider anchor 50B, the zipper-slider anchor 50A and the at least one other zipper-slider anchor 50B being affixed to the article 410 at different anchor positions. For example, the anchors 50A and 50B are spaced apart and are positioned closer to a respective end of the zipper-teeth assemblies 446 and 448. As such, the zipper-slider body 10 can be retained at different positions along the zipper in order to selectively open the zipper to different extents, depending on which anchor is coupled to the zipper puller 12.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

The invention claimed is:

1. A zipper assembly comprising:

a zipper-slider body having a puller-retention link, a first zipper-teeth guide slot and a second zipper-teeth guide slot, wherein a first set of zipper-teeth of a first zipper-teeth assembly are passable through the first zipper-teeth guide slot, and wherein a second set of zipper-teeth of a second zipper-teeth assembly are passable through the second zipper-teeth guide slot;

a zipper puller coupled directly to the zipper-slider body, the zipper puller including a puller attachment loop and a hitch loop that are separated by a cross member, the puller attachment loop being interlocked with the puller-retention link, the hitch loop including a gate that is movable between an open position and a closed position; and a zipper-slider anchor that releasably attaches to the hitch loop;

wherein the zipper-slider anchor is positioned at a location that is in between a first end and a second end of the first and second zipper-teeth assemblies.

2. The zipper assembly of claim 1, wherein the hitch loop and the gate include at least part of a carabiner, and wherein the cross member separates the puller attachment loop from the carabiner.

3. The zipper assembly of claim 1 further comprising, a spring-loaded coupling that hingedly attaches the gate to the cross member.

4. The zipper assembly of claim 3, wherein the gate includes a spring-loaded wire gate.

5. The zipper assembly of claim 1, wherein the gate includes a threaded nut, and the hitch loop and the gate include at least part of a maillon-type link.

6. The zipper assembly of claim 1, wherein the zipper-slider body further comprises:

a first plate and a second plate that are connected by a web, the first plate including a web-facing surface and a puller-facing surface, the puller-facing surface facing away from the web-facing surface, wherein the first zipper-teeth guide slot is between the web-facing surface of the first plate and the second plate and on a first side of the web, and wherein the second zipper-teeth guide slot is between the web-facing surface of the first plate and the second plate and on a second side of the web, the puller-retention link being coupled to the puller-facing surface.

7. The zipper assembly of claim 1, wherein the first zipper-teeth assembly, the second zipper-teeth assembly, and the zipper-slider anchor are coupled to a garment.

8. The zipper assembly of claim 1, wherein the first zipper-teeth assembly, the second zipper-teeth assembly, and the zipper-slider anchor are coupled to a bag.

9. The zipper assembly of claim 8, wherein the zipper-slider anchor is positioned on the bag at a location that is in between a first end and a second end of the first and second zipper-teeth assemblies.

10. The zipper assembly of claim 1, wherein the first and second zipper-teeth assemblies form a releasable fastener for a garment pocket.

11. An upper body garment comprising a first portion and a second portion:

an offset zipper assembly, the offset zipper assembly comprising:

a first zipper-teeth assembly attached to a first textile edge of the first portion;

a second zipper-teeth assembly attached to a second textile edge of the second portion, the second portion having a larger surface area than the first portion, wherein the second portion comprises a zipper-slider anchor;

a zipper-slider body coupled to the first zipper-teeth assembly and the second zipper teeth assembly, the zipper-slider body having a puller-retention link; and a zipper puller coupled directly to the zipper-slider body, the zipper puller including a puller attachment loop and a hitch loop that are separated by a cross member, the puller attachment loop being interlocked with the puller-retention link, the hitch loop including a gate that is movable between an open position and a closed position, wherein the hitch loop being releasably attachable to the zipper-slider anchor when the zipper-slider body is located in between a first end and a second end of the first and second zipper-teeth assemblies.

12. The upper body garment of claim 11, wherein the first textile edge is releasably attachable to the second textile edge by traversing the zipper-slider body along the first zipper-teeth assembly and the second zipper-teeth assembly.

13. The upper body garment of claim 12, wherein the first textile edge and the second textile edge form an opening to a pocket of the upper body garment.

14. An article with a zipper assembly, the article comprising:

a first zipper-teeth assembly;

a second zipper-teeth assembly;

a zipper-slider body that is attachable to the first zipper-teeth assembly and the second zipper-teeth assembly, the zipper-slider body having a puller-retention link, the zipper-slider body being traversable through a series of slider positions along the first and second zipper-teeth assemblies when the zipper-slider body is attached to the first and second zipper-teeth assemblies;

a zipper puller coupled directly to the zipper-slider body, the zipper puller including a puller attachment loop and a hitch loop that are separated by a cross member, the puller attachment loop being interlocked with the puller-retention link, the hitch loop including a gate that is movable between an open position and a closed position; and a plurality of zipper-slider anchors affixed to the article at different anchor positions, the hitch loop being releasably attachable to the plurality of zipper-slider anchors when the zipper-slider body is located at one or more slider positions of the series of slider positions located in between a first end and a second end of the first and second zipper-teeth assemblies, wherein traversal of the zipper-slider body along the first and second zipper-teeth assemblies is impeded when the hitch loop is attached to one of the plurality of zipper-slider anchors, wherein the zipper-slider body is retainable at a first slider position by releasably attaching the hitch loop to a first zipper-slider anchor at a first anchor position, and wherein the zipper-slider body is retainable at a second slider position by releasably attaching the hitch loop to at least one other zipper-slider anchor at a second anchor position, the first slider position being different from the second slider position.

15. The article of claim 14, wherein the article includes a bag having a first textile edge, and a second textile edge that form an opening to a pocket;

wherein the first zipper-teeth assembly is attached near the first textile edge and the second zipper-teeth assembly is attached near the second textile edge; and wherein the first textile edge is releasably attachable to the second textile edge by traversing the zipper-slider body along the first zipper-teeth assembly and the second zipper-teeth assembly.

16. The article of claim 14, wherein the article includes a footwear article having an upper, the upper including a first textile edge and a second textile edge;

wherein the first zipper-teeth assembly is attached near the first textile edge and the second zipper-teeth assembly is attached near the second textile edge; and wherein the first textile edge is releasably attachable to the second textile edge by traversing the zipper-slider body along the first zipper-teeth assembly and the second zipper-teeth assembly.

* * * * *